US008266865B2

(12) United States Patent
Neuhofer, Jr.

(10) Patent No.: US 8,266,865 B2
(45) Date of Patent: Sep. 18, 2012

(54) DEVICE FOR FRONTAL TERMINATION OF A FLOOR COVERING

(76) Inventor: Franz Neuhofer, Jr., Zell am Moos (AT)

( * ) Notice: Subject to any disclaimer, the term of this patent is extended or adjusted under 35 U.S.C. 154(b) by 367 days.

(21) Appl. No.: 12/083,709

(22) PCT Filed: Oct. 24, 2006

(86) PCT No.: PCT/AT2006/000434

§ 371 (c)(1),
(2), (4) Date: Apr. 17, 2008

(87) PCT Pub. No.: WO2007/048157

PCT Pub. Date: May 3, 2007

(65) Prior Publication Data

US 2009/0071089 A1 Mar. 19, 2009

(30) Foreign Application Priority Data

Oct. 24, 2005 (AT) ..... A 1727/2005

(51) Int. Cl.
*E04C 2/38* (2006.01)

(52) U.S. Cl. ..... 52/716.8; 52/512

(58) Field of Classification Search ..... 52/179, 52/287.1, 288.1, 290, 466, 469, 506.05, 509, 52/512, 716.8, 718.01, 718.02, 718.04, 718.05; 16/7; 428/61, 58
See application file for complete search history.

(56) References Cited

U.S. PATENT DOCUMENTS

| | | | | |
|---|---|---|---|---|
| 2,875,467 | A * | 3/1959 | De Vault | 16/7 |
| 4,067,155 | A * | 1/1978 | Ruff et al. | 52/105 |
| 5,706,623 | A * | 1/1998 | Brown | 52/718.04 |
| 5,939,670 | A * | 8/1999 | Shteynberg et al. | 174/481 |
| 6,134,854 | A * | 10/2000 | Stanchfield | 52/480 |
| 6,345,480 | B1 * | 2/2002 | Kemper et al. | 52/395 |
| 6,385,927 | B2 * | 5/2002 | Schiedegger et al. | 52/211 |
| 6,516,579 | B1 * | 2/2003 | Pervan | 52/403.1 |
| 6,550,192 | B1 * | 4/2003 | Nelson et al. | 52/177 |
| 6,588,165 | B1 * | 7/2003 | Wright | 52/506.05 |
| 7,540,067 | B2 * | 6/2009 | Colbourne et al. | 16/7 |
| 2001/0010139 | A1 * | 8/2001 | De Kerpel et al. | 52/479 |
| 2002/0162293 | A1 * | 11/2002 | Brandl | 52/506.05 |
| 2004/0237463 | A1 * | 12/2004 | Reif et al. | 52/782.1 |
| 2005/0160694 | A1 * | 7/2005 | Pervan | 52/582.1 |

FOREIGN PATENT DOCUMENTS

| | | |
|---|---|---|
| DE | 295 09 212 | 8/1995 |
| DE | 295 19 565 | 2/1996 |
| DE | 100 30 092 | 6/2001 |
| EP | 1 020 590 | 7/2000 |
| EP | 1 493 880 | 1/2005 |
| EP | 1 681 402 | 7/2006 |
| FR | 2 736 078 | 1/1997 |
| FR | 2 845 411 | 4/2004 |
| WO | WO 01/59234 | 8/2001 |

OTHER PUBLICATIONS

International Search Report.

* cited by examiner

*Primary Examiner* — Christine T Cajilig
(74) *Attorney, Agent, or Firm* — Collard & Roe, P.C.

(57) ABSTRACT

A device is described for the frontal termination of a floating-laid floor covering (3) having a terminus profile (4) and having a fastener fitting (5) for the terminus profile (4) resting on a subfloor (2). To provide advantageous design conditions, it is suggested that the fastener fitting (5) be connected in a shear-resistant manner to the floor covering (3) and have a rest (8) for the terminus profile (4) butt-jointed on the front face (1) of the floor covering (3).

17 Claims, 5 Drawing Sheets

DEVICE FOR FRONTAL TERMINATION OF A FLOOR COVERING

CROSS REFERENCE TO RELATED APPLICATIONS

This application is the National Stage of PCT/AT2006/000434 filed on Oct. 24, 2006 which claims priority under 35 U.S.C. §119 of Austrian Application No. A 1727/2005 filed on Oct. 24, 2005. The international application under PCT article 21(2) was not published in English.

FIELD OF THE INVENTION

The invention relates to a device for the frontal termination of a floating-laid floor covering having a terminus profile and having a fastener fitting for the terminus profile resting on a subfloor.

DESCRIPTION OF THE PRIOR ART

To cover the front face of a floor covering, it is typical to provide terminus profiles, which are held on a subfloor with the aid of a fastener fitting. For this purpose, the fastener fitting, which may be implemented in the form of a fastener rail or by single fittings positioned at a distance from one another along the front face to be covered of the floor covering, forms a receptacle groove between two projecting webs for a clamping web provided on the terminus profile, so that a pressfit results between the terminus profile and the fastener fitting after the insertion of the clamping web into the receptacle groove. The terminus profile is supported by a cover flange on one side on the subfloor and on the other side on the floor covering, which has a longitudinal edge section overlapped by the cover flange of the cover profile. Because of this overlap, a movement compensation between the floating-laid floor covering and the terminus profile is easily achieved, and the fastener fitting connected in a shear-resistant manner to the subfloor is fixed in relation to the subfloor. These known devices for the frontal termination of a floor covering have the disadvantage, however, that an edge elevation must necessarily be accepted due to the longitudinal edge section of the terminus profile overlapping the floor covering. In order that this step formation in the terminus area may be avoided, connecting the terminus profile in a formfitting manner to the floor covering is known, specifically via tongue-and-groove joints, which prevent both a height offset and also an offset of the terminus profile transversely to the front face of the floor covering. A continuous, flush attachment of the terminus profile to the floor covering is thus possible, but the formfitting attachment of the floor profile to the floor covering requires complex processing of the frontal edge areas of the floor covering, which may hardly be performed with the needed narrow manufacturing tolerance when laying a floor covering on location.

SUMMARY OF THE INVENTION

The invention is thus based on the object of designing a device of the type described at the beginning for the frontal termination of a floor covering in such a manner that an at least essentially continuous transition from the floor covering to the terminus profile is possible, without having to provide a formfitting connection between the floor covering and the terminus profile.

The invention achieves the stated object in that the fastener fitting is connected to the floor covering in a shear-resistant manner and has a rest for the terminus profile which is butt-jointed on the front face of the floor covering.

Because the fastener fitting is connected in a shear-resistant manner to the floor covering and therefore participates in any movements of the floating-laid floor covering, a fixed location assignment of the fastener fitting to the front terminus edge of the floor covering results, so that the terminus profile may be butt-jointed on the front face of the floor covering, if a corresponding support of the terminus profile in height is ensured. This support is achieved by a rest of the floor covering for the terminus profile which is moved with the fastener fitting and thus with the floor covering. Taking the thickness of the terminus profile in the rest area of the stop into consideration, a continuous transition between the floor covering and the terminus profile may thus be ensured easily if only the transverse displacement of the terminus profile in relation to the front face of the floor covering is prevented, which may be ensured by a corresponding connection between the terminus profile and the fastener fitting like a tongue-and-groove joint in a proven way, for example.

In order that the local assignment between the floor covering and the fastener fitting may be constructively fixed, the fastener fitting may form a stop for the front face of the floor covering. The occurring loads may advantageously be dissipated by the terminus profile onto the fastener fitting if the stop of the fastener fitting forms the rest for the terminus profile, because in this case the rest itself finds support on the front face of the floor covering via the stop.

It is possible to produce the shear-resistant connection between the floor covering and the fastener fitting for the terminus profile by gluing the rest of the fastener fitting to the front face of the floor covering, but more favorable attachment conditions result through a fastener fitting engaging below the floor covering, which allows an attachment face for an adhesive bond not determined by the front face of the floor covering, for example, which is not absolutely required, however, because only the shear-resistant connection is important.

To allow an adaptation to different thicknesses of the floor covering, a web-like part of the fastener fitting performing the rest may have intended breakpoints, with the aid of which rests for the terminus profile may be predefined at various heights. Because the resulting height gradation is comparatively slight, the inclination of the terminus profile caused by the different heights of the rest does not play a role. Shortening the support height of the rest with the aid of prepared intended breakpoints may result in a greater tolerance range of the particular support heights. In order that a narrow tolerance range for the support of the terminus profile may be ensured in spite of such intended breakpoints, the fastener fitting may form at least two rests for different thicknesses of the floor covering, of which at least the one for the thicker floor covering is implemented as web-like and provided with an intended breakpoint. If the intended breakpoint of the rest having the higher support height has a lesser height than the support height of the rest for the lesser thickness of the floor covering, after the shortening of the rest for adaptation to the thicker floor covering, the rest having the lesser support height comes to bear, which may be manufactured with a slight production tolerance, so that both support heights may be prefinished having a comparatively slight tolerance.

If the stop is implemented as one of two webs of the fastener fitting resulting in a receptacle groove for a clamping web of the terminus profile, especially simple design conditions may be maintained, because the stop may also be used for a pressfit between the terminus profile and the fastener fitting. For adaptation to greater thickness differences of the laid floor coverings, the two webs of the fastener fitting forming the receptacle groove for the clamping web of the terminus profile may have intended breakpoints, not only a height adaptation of the rest for supporting the terminus profile formed by a web, but rather also an adaptation of the depth of the receptacle groove for a clamping web being made possible by the shortening of the webs connected thereto.

The rest for supporting the terminus profile may be formed by a support body separate from the fastener fitting, which is fastened to the fastener fitting, for example, with the aid of a catch connection like a snap closure. Adaptations to floor coverings of different thicknesses may also be performed easily with the aid of such separate support bodies. It is thus possible to increase the support height of the support bodies by inserts or to reduce it by prepared intended breakpoints. Especially favorable design conditions result in connection with separate support bodies for the rest of the terminus profile if the support body results in the part of a pressfit for the terminus profile associated with the fastener fitting.

A further embodiment of a rest for the terminus profile is obtained in that the rest comprises a plastic body, preferably made of hard foam, glued on one side to the fastener fitting and on the other side to the terminus profile during its curing. This plastic body may be applied to the fastener fitting before its curing and may be compressed to the support height required for the particular thickness of the floor covering with the aid of the terminus profile attached butt-jointed to the floor covering, to obtain not only a location of the terminus profile adapted precisely to the thickness of the floor covering, but rather also good fastening of the terminus profile to the fastener fitting after the curing. Plastic bodies made of hard foam are especially suitable for this purpose.

In order that the fastener fitting connected in a shear-resistant manner to the floating-laid floor covering may be prevented from lifting off of the subfloor without endangering the free movement compensation for the floor covering, the fastener fitting may have oblong holes running transversely to the front face for receiving fastener screws engaging in the subfloor. The floor covering is retained pressed against the subfloor in its edge area by this measure. The oblong holes penetrated by the fastener screws ensure the required movement play transversely to the front face of the floor covering. The terminus profile may also additionally be secured against lifting off of the subfloor if the fastener fitting has a projecting clamping web engaging in a groove of the terminus profile in the area of its longitudinal edge facing away from the front face of the floor covering. This clamping web prevents unintentional lifting off of the terminus profile from the fastener fitting, which is significant in particular if the fastener fitting is also fixed in height in relation to the subfloor with the aid of fastener screws.

If the terminus profile is additionally bonded to the front face of the floor covering by an adhesive layer, in addition to a liquid-tight terminus of the butt joint between the terminus profile and the floor covering, an additional attachment of the terminus profile to the floor covering is also made possible.

To cover processing errors in the area of the visible longitudinal edge of the front face of the floor covering, the terminus profile may finally form a lug overlapping the upper longitudinal edge of the front face of the floor covering adjoining the abutting surface, which does not impair the essentially continuous transition between the floor covering and the terminus profile because of its possibly slight thickness.

BRIEF DESCRIPTION OF THE DRAWING

The subject matter of the invention is illustrated as an example in the drawing. In the figures of the drawing

DESCRIPTION OF THE PREFERRED EMBODIMENTS

Figure 1:
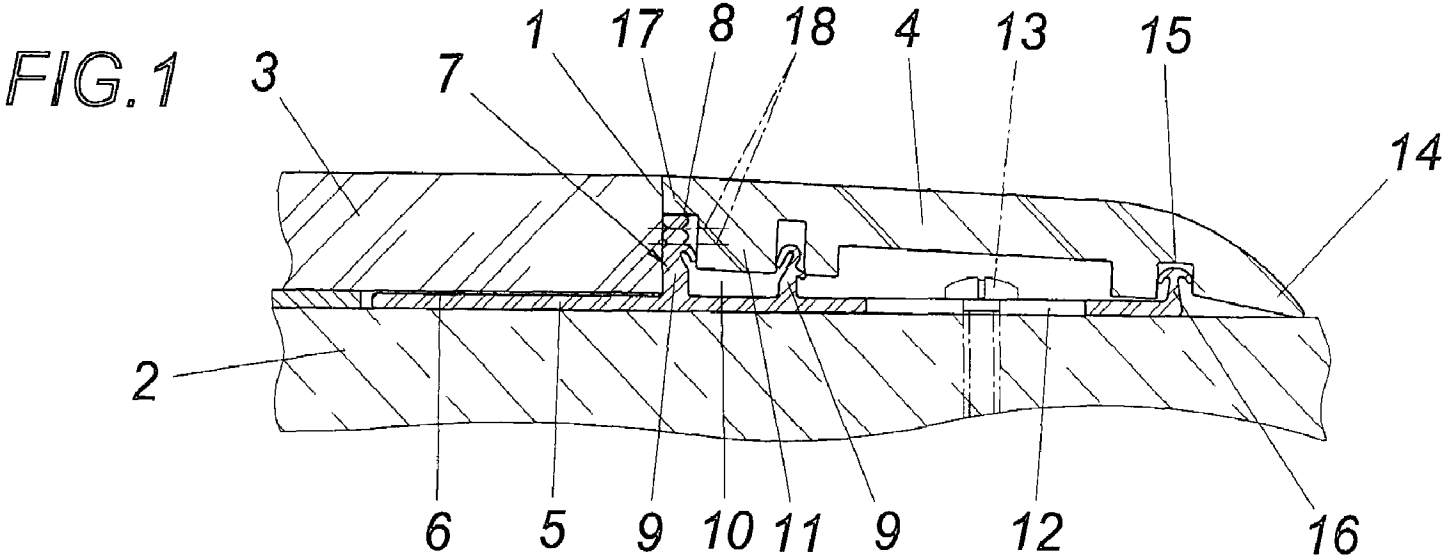
FIG. 1 shows a device according to the invention for the frontal termination of a floor covering in a simplified cross-section.
Figure 2:
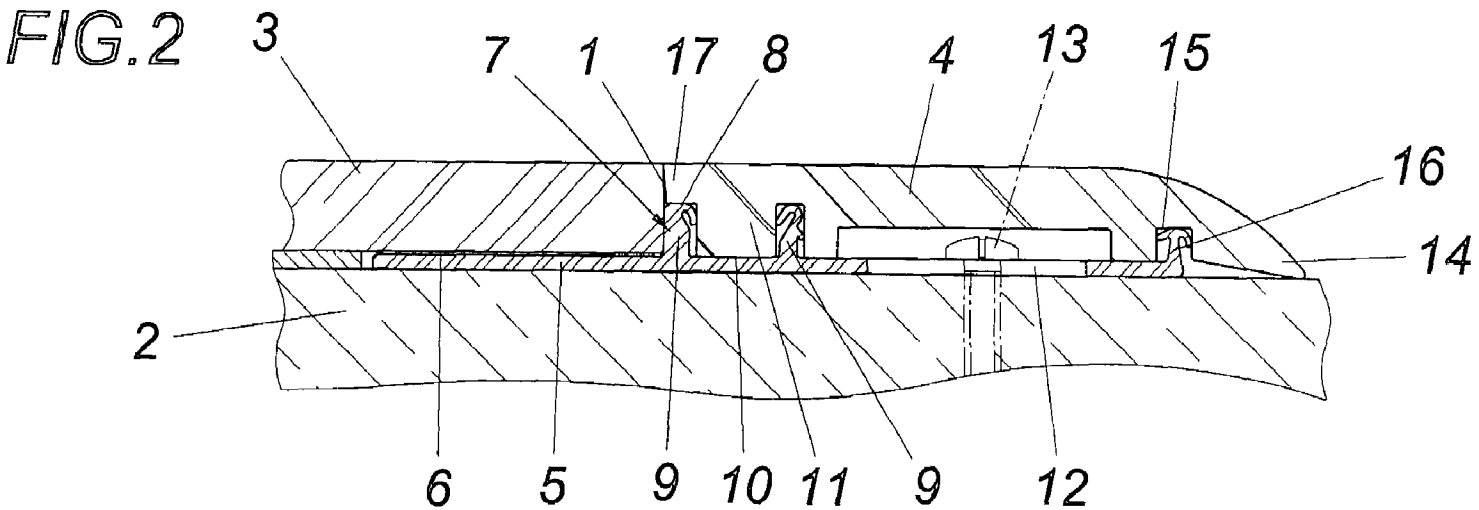
FIG. 2 shows the device from FIG. 1 after an adaptation to a floor covering having a low thickness.

As may be seen from the exemplary embodiment in FIGS. 1 and 2, the front face 1 of a floor covering 3 laid floating on the subfloor 2 is covered with the aid of a terminus profile 4, which is retained in a fastener fitting 5. This fastener fitting 5 engages below the floor covering 3 and is connected in a shear-resistant manner to the floor covering 3 via an adhesive 6. The location of the fastener fitting 5 in relation to the front face 1 of the floor covering 3 is constructively fixed by a stop 7 for the front face 1 of the floor covering 3. This stop 7 forms a rest 8 for the terminus profile 4, which adjoins the front face 1 of the floor profile 3 butt-jointed and thus ensures a continuous transition from the floor profile 3 to the terminus profile 4, without having to additionally process the floor covering 3 in area of the front face 1.

The retention of the terminus profile 4 in the fastener fitting 5, which is implemented in the exemplary embodiment as a fastener rail, but may also comprise individual fitting parts distributed along the frontal edge course of the floor covering 3, is achieved in a proven manner by a pressfit like a tongue-and-groove joint, the stop 7 being formed as one of two webs 9 of the fastener fitting, between which a receptacle groove 10 for a clamping web 11 of the terminus profile 4 results. This retention of the terminus profile 4 in the fastener fitting 5 represents a guide for the terminus profile 4 which is secure from displacement transversely to the front face 1 of the floor covering 3 and thus ensures a seamless attachment of the terminus profile 4 to the front face 1 of the floor covering 3, in particular if a corresponding pre-tension is exerted on the terminus profile 4 via the web 7 of the receptacle groove 10 farther away from the front face 1.

In order that the floor covering 3, which is laid floating on the subfloor 2, may be secured from lifting off of the subfloor in the frontal edge area, the fastener fitting 5 has oblong holes 12 which run transversely to the front face 1 of the floor covering 3 and are used for receiving fastener screws 13. In spite of the fastener screws 13 anchored in the subfloor 2, the movement compensation for the floor covering 3 transversely to its front face 1 is not obstructed, because the fastener screws 13 penetrate the fastener fitting 5 in the oblong holes 12. The fastener fitting 5 may have a projecting clamping web 16 engaging in the groove 15 of the terminus profile 4 in the area of its external longitudinal edge to secure the terminus profile 4 against lifting off in the area of the longitudinal edge 14 opposite to the floor covering 3.

The location of the terminus profile 4 is determined on one hand by its longitudinal edge 14, which is supported on the subfloor 2, and on the other hand by its joint-side edge 17 resting on the rest 8 of the stop 7. An adaptation to different thicknesses of the floor covering 3 may thus be performed by changing the support height of the rest 8. For this purpose, the stop 7 is provided with two intended breakpoints is shown in FIG. 1, which allow a step-by-step reduction of the support height 18, as indicated via the support heights 18 shown by dot-dash lines. While the position for the thickest floor covering 3 is shown in FIG. 1, an adaptation to the thinnest floor covering 3 has been performed in FIG. 2, in that the stop 7 was shortened corresponding to the lowest intended breakpoint. In spite of this measure, a seamless attachment of the terminus profile 4 to the front face 1 of the floor profile 3 remains, because only the support height, but not the attachment conditions have changed. However, the terminus profile 4 displays a different inclination in relation to the subfloor 2, which does not play a role in consideration of the triviality of the inclination changes.

Figure 3:
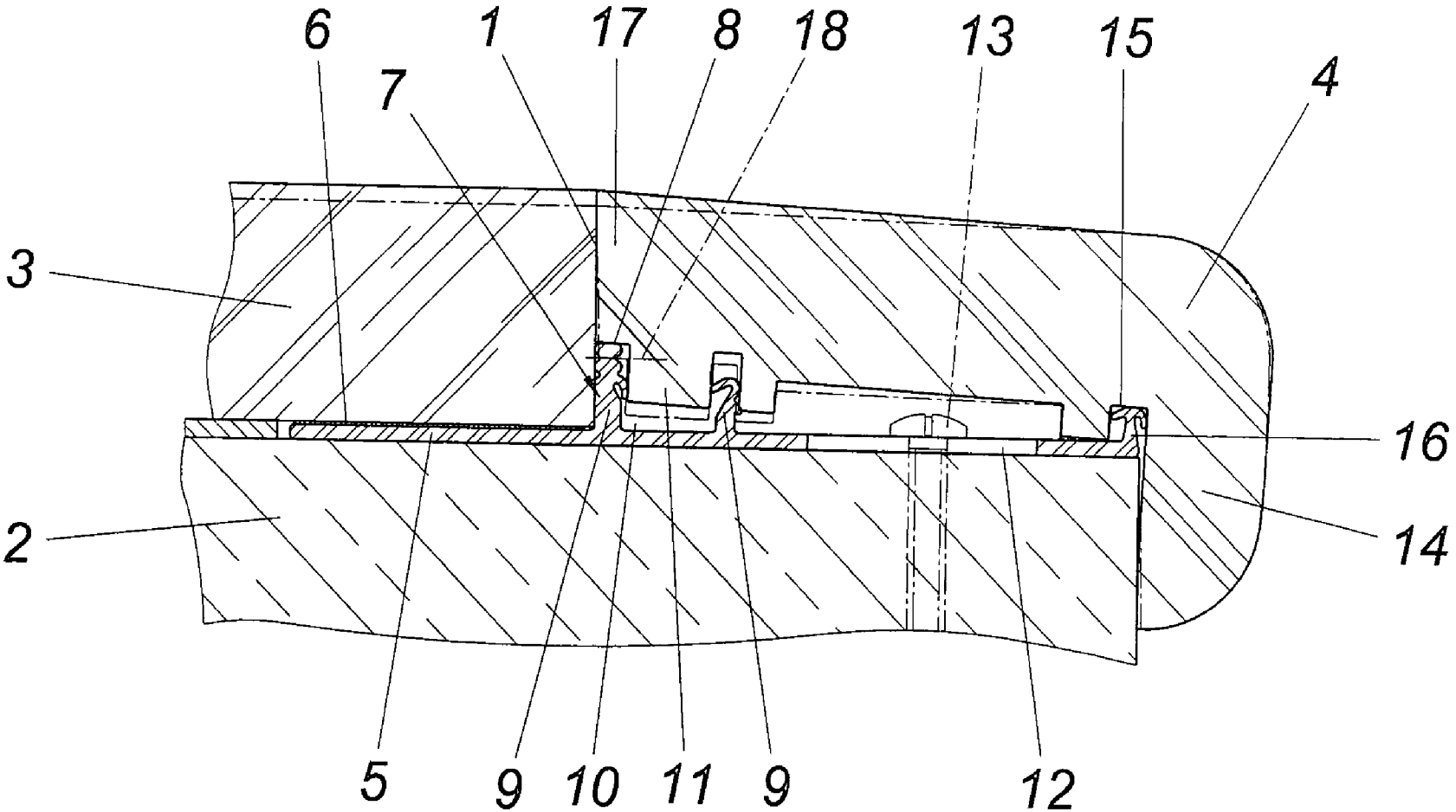
FIG. 3 shows an embodiment variant of a device according to the invention, also in a simplified cross-section.

As shown in FIG. 3, the invention may also be used in floor coverings 3 of stair steps, the terminus profile 4 overlapping the tread area in the riser area, as is typical in such terminus profiles. However, fundamentally identical conditions result in regard to the continuous attachment of the terminus profile 4 to the floor covering 3. The subfloor 2 is formed by the tread, on which the fastener fitting 5 rests and is secured against lifting off with the aid of the fastener screws 13. Because the fastener fitting 5 is connected in a shear-resistant manner to the floor covering 3, the fastener fitting 5 and the terminus profile 4 connected thereto participate in any movements of the floor covering 3, so that no relative movements may result transversely to the front face 1 of the floor covering 3 between the floor covering 3 and the terminus profile 4.

The rest 8 may also be adapted to different thicknesses of the floor covering 3 with the aid of intended breakpoints in a stair step terminus as shown in FIG. 3. The terminus profile 4 for the thickest floor covering 3 is shown by solid lines in FIG. 3. The configuration for a moderate thickness of the floor covering 3 is indicated in dot-dash lines.

Figure 4:
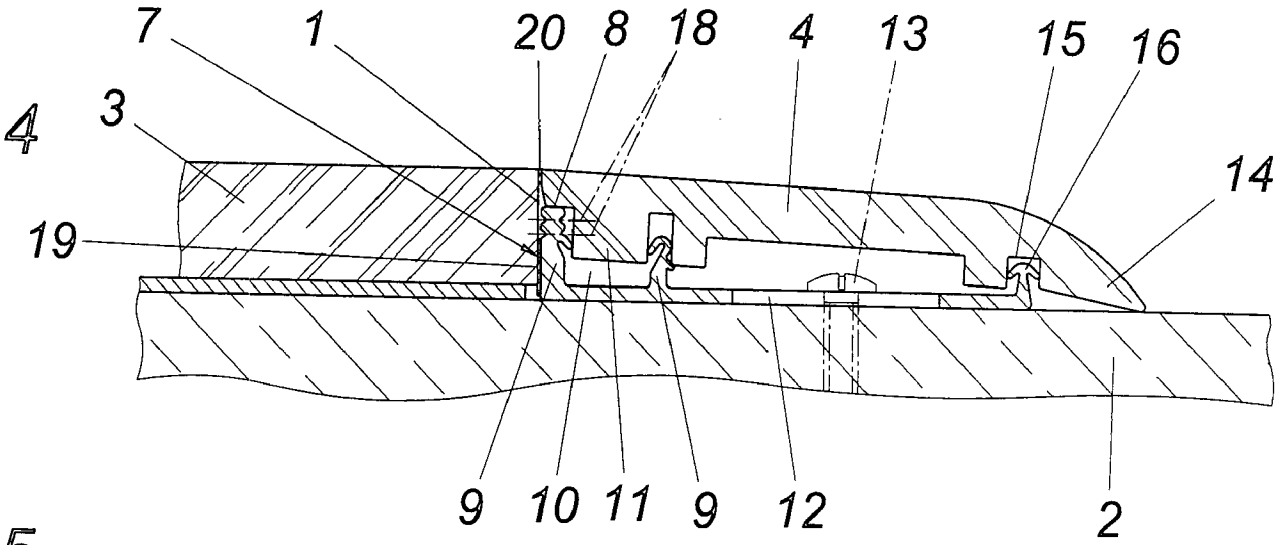
FIG. 4 shows a further embodiment of a device according to the invention in an illustration corresponding to FIG. 1.

The embodiment of the device illustrated in FIG. 4 differs from the design from FIGS. 1 and 3 solely in that the fastener fitting 5 does not have a section engaging below the floor covering 3, but rather is connected using the stop 7 to the front face 1 of the floor covering 3 via an adhesive layer 19, so that a shear-resistant connection between the fastener fitting 5 and the floor covering 3 again results as a requirement for a seamless attachment of the terminus profile 4 to the front face 1 of the floor covering 3. The joint area between the floor covering 3 and the terminus profile 4 may additionally be sealed by an adhesive layer 20, which not only prevents the penetration of moisture into the area of the butt joint, but rather also ensures an additional connection of the terminus profile 4 to the floor covering 3.

Figure 5:
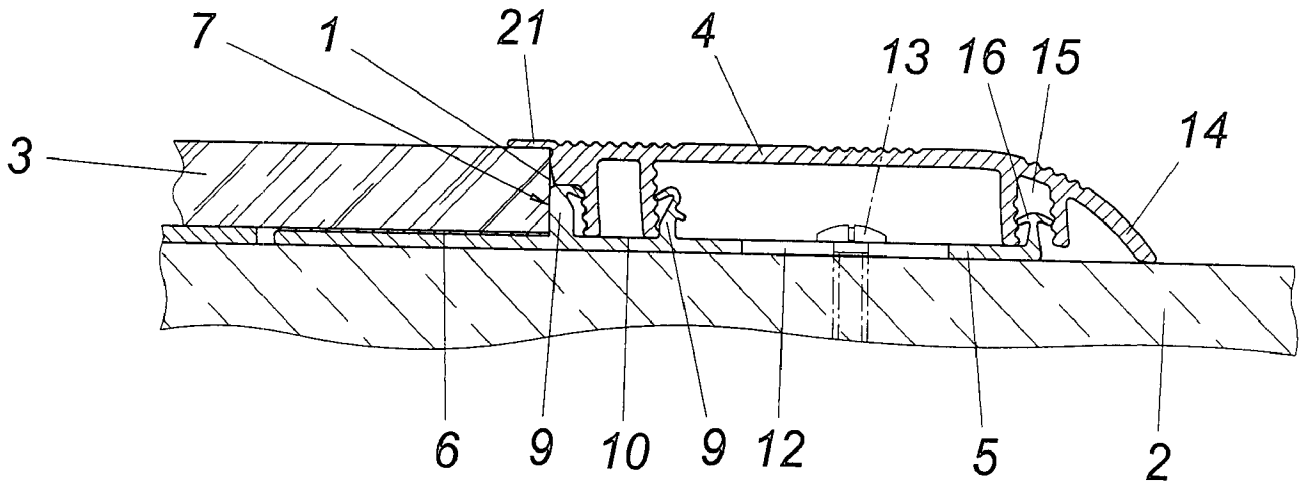
FIG. 5 shows a device according to the invention having a metallic terminus profile in a simplified cross-section.

If the terminus profile 4 is formed by a metal profile, which is preferably extruded, as shown in FIG. 5, the terminus profile 4 may form a lug 21 overlapping the upper longitudinal edge of the front face 1 of the floor covering 3 adjoining the abutting surface, which does not interfere because of the low thickness and ensures coverage of any locally occurring gaps between the front face 1 of the floor covering 3 and the terminus profile 4.

Figure 6:
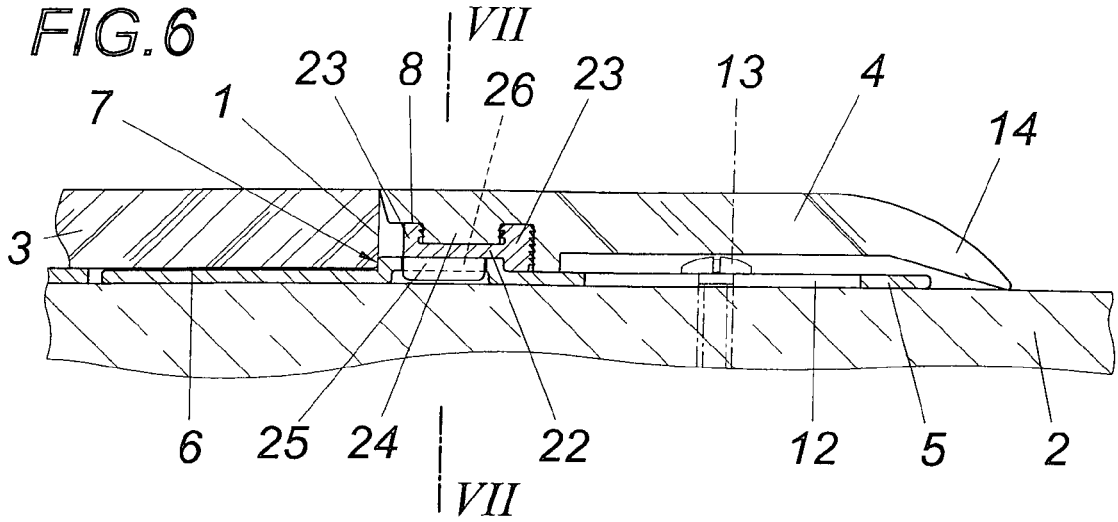
FIG. 6 shows an embodiment of a device according to the invention having a separate support body as a rest for the terminus profile in a simplified cross-section.
Figure 7:
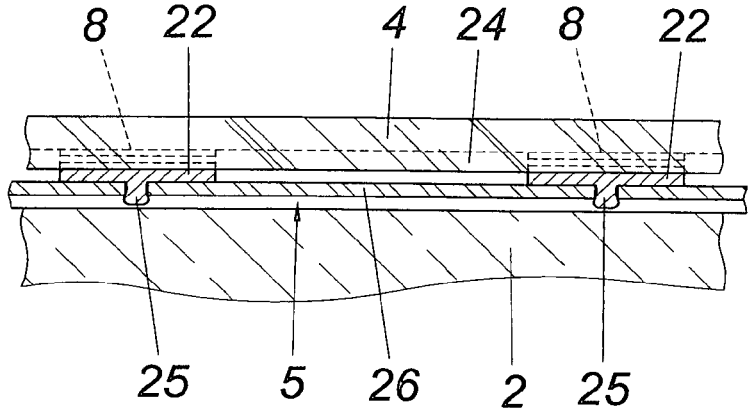
FIG. 7 shows a section along line VII-VII of FIG. 6.

The rest 8 for the terminus profile 4 may be formed as shown in FIGS. 6 and 7 by a support body 22 fastenable to the fastener fitting 5, which preferably results in the part associated with the fastener fitting 5 of a pressfit for the terminus profile 4 in the form of two webs 23, between which a clamping web 24 of the terminus profile 4 engages. The support body 22 is provided with a downwardly projecting catch projection 25 for the fastening, which engages like a snap closure in a socket receptacle of the fastener fitting 5. The fastener fitting 5 is provided with a right-angle bend 26 for this purpose, which simultaneously results in the stop 7 of the fastener fitting 5 for the front face 1 of the floor covering 3. The support body 22 may be provided with inserts for increasing the support height so that the terminus profile 4 may be adapted to different thicknesses of the floor covering 3. However, it is also possible to provide intended breakpoints for shortening the support height, for example, in the area of the webs 23.

Figure 8:
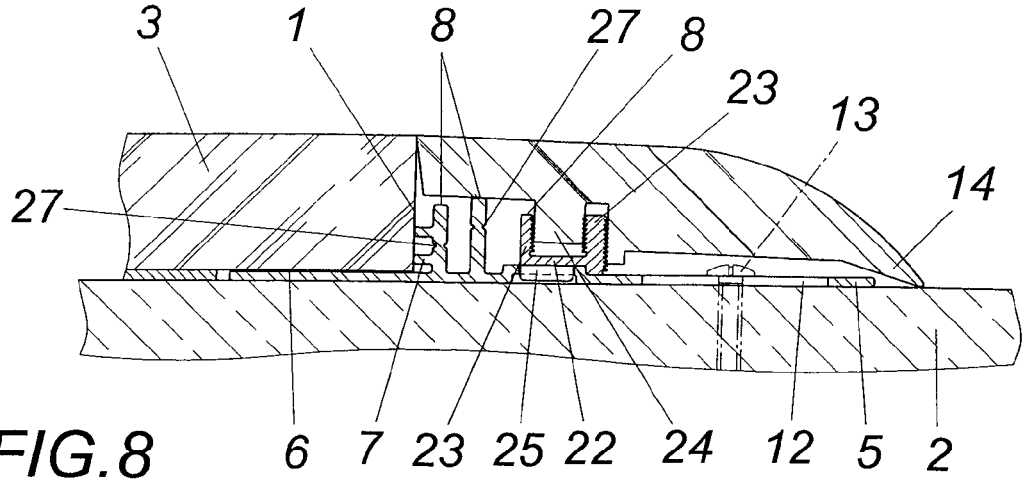
FIGS. 8 through 10 shows a further embodiment of a device according to the invention in various adaptation positions, each in cross-section.
Figure 9:
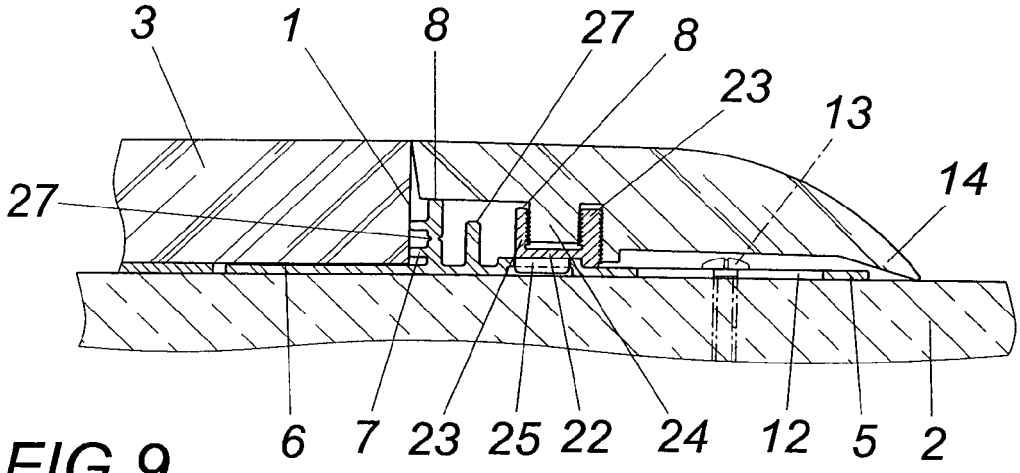
Figure 10:
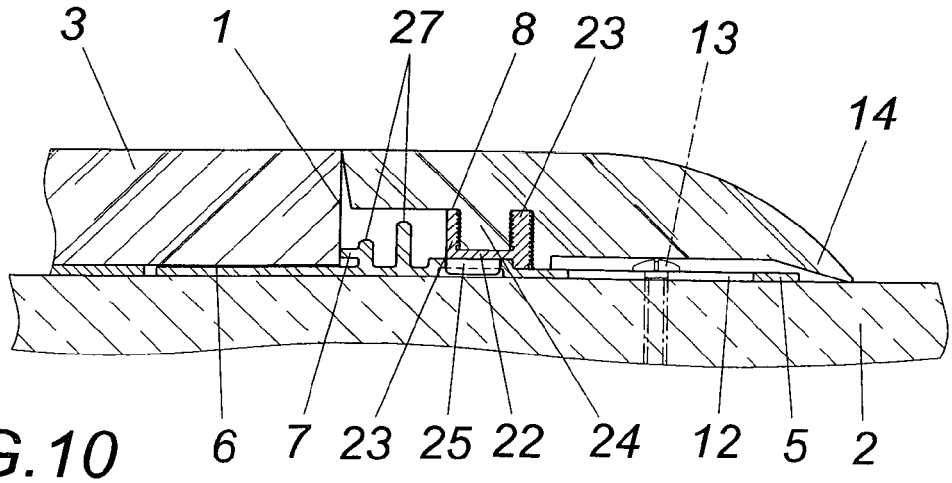

As shown in FIGS. 8 through 10, multiple rests 8 may also be provided for different support heights, to be able to ensure narrow manufacturing tolerances for each of these support heights. In the position for the thickest floor covering 3, the middle rest 8 having the greatest support height is used as shown in FIG. 8. This rest 8 is provided with an intended breakpoint 27, which is lower than the rest 8 having the lowest support height. The rest 8 having the lowest support height is formed by a support body 22 corresponding to FIGS. 6 and 7, this support body 22 also representing a pressfit for the terminus profile 4. After the rest 8 having the highest support height is shortened, the rest 8 having the middle support height is used, as shown in FIG. 9. The rest 8 having the middle support height is also provided with an intended breakpoint 27 below the rest 8 for the lowest support height, so that after this rest 8 is shortened along the intended breakpoint 27, the terminus profile 4 rests on the support body 22 and its rest 8. Therefore, the intended breakpoints 27 are not used as new rests, as is the case in FIGS. 1 and 2, for example, but rather separate, prefinished rests 8 having correspondingly more precise support height.

Figure 11:
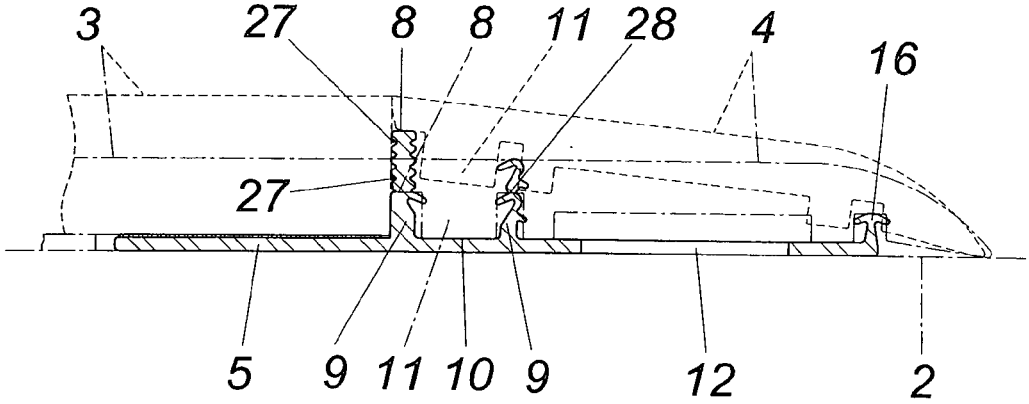
FIG. 11 shows a fastener fitting for adaptation to a comparatively large thickness range of the floor coverings to be terminated in a cross-section.

A fastener fitting 5 is shown in FIG. 11, which is capable of adapting the terminus profile 4 to a comparatively large thickness range of the floor covering. The fastener fitting 5 constructed in accordance with FIGS. 1 and 2 forms two webs 9, between which a receptacle groove 10 for a clamping web 11 of the terminus profile 4 results. The web 9 forming a rest 8 for the terminus profile 4 has a comparatively large support height having multiple intended breakpoints 27. In order that not only large, but rather also small support heights may be used, the other web 9 also has to be provided with an intended breakpoint 28, so that the clamping web 11 of the terminus profile 4 may be held clamped between the webs 9 both for the thickest and also for the thinnest floor covering 3. The position of the terminus profile 4 for the thickest floor covering is shown by dashed lines and for the thinnest floor covering 3 by dot-dash lines in FIG. 11, the necessity of shortening of the web 9 not forming the rest 8 also being clearly shown.

The invention claimed is:

1. A frontal termination system comprising:

a terminus profile;

a floating-laid floor covering having a front, a bottom face, a front face, and a top face opposite the bottom face, the bottom face being for resting on a subfloor, the front face extending from the bottom face, the front face abutting the terminus profile up to the top face as the floating-laid floor covering is jointed with the terminus profile to terminate the front of the floating-laid floor covering, and the floating-laid floor covering being movable along the subfloor when the floating-laid floor covering is set on the subfloor; and a fastener fitting for the terminus profile, the fastener fitting being able to rest on the subfloor, being connected to the floating-laid floor covering in a shear-resistant manner so that the fastener fitting moves with the floating-laid floor covering when the floating-laid floor covering is on the subfloor and moves along the subfloor, and having a rest for the terminus profile;

wherein the fastener fitting has oblong holes running transversely to the front face of the floor covering for receiving fastener screws able to engage in the subfloor; and wherein the terminus profile adjoins the front face of the floating-laid floor covering in an abutting manner so that no formfitting connection is provided between the floating-laid floor covering and the terminus profile.

2. The frontal-termination system according to claim 1, wherein the fastener fitting forms a stop for the front face of the floating-laid floor covering.

3. The frontal-termination system according to claim 2, wherein the stop of the fastener fitting forms the rest for the terminus profile.

4. The frontal-termination system according to claim 1, wherein the fastener fitting engages below the floating-laid floor covering.

5. The frontal-termination system according to claim 1, wherein a web-like part of the fastener fitting forms the rest and has intended breakpoints for adapting the rest to different thicknesses of the floating-laid floor covering.

6. The frontal-termination system according to claim 5, wherein the fastener fitting forms at least two rests for different thicknesses of the floating-laid floor covering, and at least one of the at least two rests is web-like and is provided with an intended breakpoint for the thicker floor covering.

7. The frontal-termination system according to claim 2, wherein the stop is implemented as one of two webs of the fastener fitting resulting in a receptacle groove for a clamping web of the terminus profile.

8. The frontal-termination system according to claim 7, wherein the two webs of the fastener fitting forming the receptacle groove for the clamping web of the terminus profile have intended breakpoints for adaptation to different thicknesses of the floating-laid floor covering.

9. The frontal-termination system according to claim 1, wherein the rest comprises a support body fastenable to the floating-laid fastener fitting.

10. The frontal-termination system according to claim 9, wherein inserts are provided to increase the support height for the support body.

11. The frontal-termination system according to claim 9, wherein the support body has at least one intended breakpoint to reduce the support height.

12. The frontal-termination system according to claim 9, wherein the support body forms part of a pressfit for the terminus profile associated with the fastener fitting.

13. The frontal-termination system according to claim 1, wherein the rest comprises a plastic body, said plastic body being glued during curing of the plastic body to the fastener fitting and to the terminus profile.

14. The frontal-termination system according to claim 1, wherein the fastener fitting has a projecting clamping web engaging in a groove of the terminus profile in an area of a longitudinal edge of the terminus profile, the area of the longitudinal edge facing away from the front face of the floating-laid floor covering.

15. The frontal-termination system according to claim 1, wherein the terminus profile is connected to the front face of the floating-laid floor covering by an adhesive layer.

16. The frontal-termination system according to claim 1, wherein the terminus profile forms a lug overlapping an upper longitudinal edge of the front face of the floating-laid floor covering adjoining the terminus profile.

17. The frontal-termination system according to claim 13, wherein the plastic body is made of hard foam.

* * * * *